United States Patent [19]

Kirchweger et al.

[11] 4,338,889

[45] Jul. 13, 1982

[54] LOW-NOISE LEVEL INTERNAL COMBUSTION ENGINE

[75] Inventors: Karl Kirchweger; Heinz Fachbach; Josef Greier, all of Graz, Austria

[73] Assignee: Hans List, Graz, Austria

[21] Appl. No.: 146,276

[22] Filed: May 5, 1980

[51] Int. Cl.[3] ..... F02M 33/02

[52] U.S. Cl. ..... 123/198 E; 123/195 C; 123/195 S

[58] Field of Search ..... 123/198 E, 195 C, 195 S, 123/41.7, 52 M; 181/204

[56] References Cited

U.S. PATENT DOCUMENTS

| | | | |
|---|---|---|---|
| 1,133,531 | 3/1915 | Breath | 123/195 C |
| 3,924,597 | 12/1975 | Hatz et al. | 123/195 C |
| 4,071,008 | 1/1978 | Skatsche et al. | 123/195 C |
| 4,149,512 | 4/1979 | Hatz | 123/195 C |
| 4,183,344 | 1/1980 | Kirchweer et al. | 123/198 E |
| 4,203,409 | 5/1980 | Fachbach et al. | 123/195 C |
| 4,213,439 | 7/1980 | Feichtinger et al. | 123/198 E |
| 4,230,087 | 10/1980 | Abe et al. | 123/198 E |
| 4,257,369 | 3/1981 | Abe et al. | 123/195 C |

FOREIGN PATENT DOCUMENTS 2245126 4/1973 Fed. Rep. of Germany ... 123/198 E

*Primary Examiner*—Raymond A. Nelli

*Attorney, Agent, or Firm*—Watson, Cole, Grindle & Watson

[57] ABSTRACT

In an internal combustion engine the power generating parts mainly responsible for body resonance and sound vibration such as the crankshaft (3), cylinder block and cylinder head (35) are combined in a power unit which is supported in the crankcase (4) on elastic vibration-absorbing mountings (2) with the sidewalls of the crankcase (4) extending above the crankshaft axis (3).

By this arrangement the crankcase (4) is free from direct vibrations leaving other non-power transmitting engine parts mounted above the crankcase (4) which require means to suppress radiated noise.

In one embodiment the induction manifold (7) and mounting parts (13, 14) thereof together with the rocker cover (20) are insulated from the cylinder head (35) by vibration-absorbing elements (8,15,16,21,26) and are so shaped and arranged that they provide a screen for noise radiated from the cylinder head (35). Thus, essential parts of the engine have the secondary function of reducing the level of noise emitted by the engine.

14 Claims, 5 Drawing Figures

LOW-NOISE LEVEL INTERNAL COMBUSTION ENGINE

BACKGROUND OF THE INVENTION

This invention relates to a cylinder head internal combustion engine wherein the parts directly affected by body resonance and sound vibration, namely the engine unit support which carries the crankshaft main bearings, as well as the cylinderhead and associated auxiliary units, are connected to the crankcase, which itself extends upwardly to a level above the crankshaft axis, by means of at least one vibration-absorbing element secured to the engine unit support, and wherein the vibrated parts above the crankcase are provided with a sound-suppressing covering.

DESCRIPTION OF THE PRIOR ART

Owing to the elastic suspension of the main vibration-generating parts, namely the engine unit support and the cylinder head with associated auxiliary units, within the crankcase which is constructed to extend upwardly above the middle of the crankshaft, the crankcase itself is largely free of directly transmitted sound vibrations and its sound emission level is acceptably low. However, in view of the logarithmic addition of noise sources, a significant reduction of noise level will occur only when, to the extent possible, all vibration-transmitting parts are inhibited from emitting noise by radiation; thus it is vitally important that the remainder of the upper engine region, that is to say the vibrated parts which are situated above the crankcase, also be enclosed or otherwise prevented from emitting noise by radiation.

In the arrangement described in German laid out print 26 12 182 the engine parts located above the crankcase which vibrate and emit noise are surrounded by a noise-suppressing covering which is secured to the engine case and to the flywheel case. Such an additionally fitted enclosure, whilst providing an efficient noise screen for the engine parts above the crankcase, involves the application of additional fittings and parts to the internal combustion engine as a whole and thus detrimentally results in an increased weight and enlarged overall outside dimensions. Moreover, with this kind of covering or encapsulation there must be additional provision made for adequate ventilation and cooling of the capsule interior which is heated by the engine, and for the use of easily removable covers or the like to afford ready access to the parts and units for repair and maintenance purposes.

It is further known from Austrian Patent No. 350,855 to provide each of the intake and the exhaust ducts in an internal combustion engine of the kind specified with a vibration-insulating intermediate link forwardly of the points where these ducts extend through the enclosure walls and to support from the crankcase those parts of the pipes which extend out of the enclosure. Such an arrangement entails a comparatively large outlay to provide appropriate support for the pipes in addition to the provision of the noise-suppressing covering.

It is an object of the present invention to reduce the number of parts required in connection with the noise-suppression of the internal combustion engine and particularly the need for additional parts to form the enclosure, and to improve the accessibility of all units requiring regular maintenance.

SUMMARY OF THE INVENTION

According to the present invention, due to the fact that at least one of the non-power-transmitting parts situated above the crankcase and not participating in power transmission but secured to directly vibrated parts, such as for example the induction manifold for air or for the air/fuel mixture, or the rocker cover, is insulated against the direct transmission of body sound and sound vibrations from the power-transmitting parts to which it is secured, for example, the cylinder head, and is constructed and arranged in such a way that it at least partially covers or overlaps other engine parts which are not vibration-insulated and extraneous to its own functional range, such part can constitute at least one additional part of the sound-suppressing covering. Such an arrangement reduces the number of parts which transmit sound vibrations and therefore emit noise by radiation, and acts to reduce the number of additional parts which must be fitted to the parts already present on the engine for covering or encapsulating the noise-emitting parts. Moreover, no additional parts or components are needed for supporting the engine pipes which pass through the enclosure walls.

According to a further development of this invention the insulation against direct transmission of body resonance and sound vibrations is obtained by means of separate sealing and fastener elements consisting, at least partially, of an elastic vibration-absorbing material. This ensures that vibrations will not be transmitted again by the fastener elements to any parts which have been effectively insulated against vibrations by means of elastic sealing elements and which would considerably impair the effectiveness of the anti-vibration insulation.

According to a particular embodiment of the invention vibration-absorbing and sealing intermediate rings which, for example, may be made of rubber, are provided between the cylinder head and the induction manifold for air or for the fuel/air mixture. This effectively isolates the manifold as a whole from the cylinder head with regard to sound-producing vibration and may thus also contribute to the sound-suppression for the cylinder head, so that, by special design of an existing part, it is possible to dispense with the provision of an additional part which would necessarily add to weight and volume.

According to a preferred embodiment of the invention the anti-vibration intermediate rings may be adapted to connect the induction manifold to a short piece of pipe which is press-fit in the inlet port of the cylinder head. The press-fit of the short piece of pipe in the cylinder head greatly facilitates the provision of the induction manifold insulation according to this invention.

In further development of the invention the induction manifold is provided at each of its ends with a part which embraces the cylinder head substantially in U-fashion and is secured to the cylinderhead by means of vibration-absorbing elements. These two U-shaped parts provide, on the one hand, effective noise-screening of the cylinder head end faces and, on the other hand, a secure and vibration-insulated fastening for the induction manifold to a suitable point on the cylinder head.

According to a further aspect of the invention, particularly as applied to an engine of the kind comprising an exhaust gas-driven turbo-charger, one of the two U-shaped parts is designed as a connecting elbow section from the inlet manifold to the turbo-charger, the connection of the inlet manifold by means of the two U-shaped end parts is arranged on that side of the cylinderhead which is opposite the induction manifold. The vibration-absorbing fastener elements can thus take up the thrust created by the charging pressure when the engine is supercharged, which would force the induction manifold away from the pipe connector on which it is fitted.

According to a further development of the invention the induction manifold, including the two U-shaped end parts associated therewith, is sealed relative to the crankcase by means of an elastic lip seal which, for example, may be made of rubber. This circumferentially continuous lip seal prevents radiated noise emission between the crankcase and the induction manifold together with the two U-shaped parts.

According to this invention the passages for coolant feed and/or return hoses to the cylinder head may be arranged in enlargements of smaller diameter than the hose diameter in the dividing gap between the induction manifold and one of the U-shaped parts. A conventional elastic hose of the kind normally used for these applications can thus be easily fixedly clamped between the manifold and one of the U-shaped parts, thus providing a good sound-proof seal for the passage.

In further development of the invention it is also possible for the rocker arm cover to be sealed relative to the cylinderhead by a circumferentially continuous vibration-absorbing gasket or sealing element and to be secured to the cylinderhead by means of screws and vibration-absorbing washers. This arrangement reflects a further beneficial application of the principle of this invention, namely that of isolating existing parts in respect of vibration transmission and using them as cover elements for other parts which are subject to sound-producing vibrations. The vibration-absorbing washers on the screws that vibrations cannot be directly re-transmitted to the rocker arm cover which has already been insulated relative to the cylinderhead by the circumferentially continuous sealing element. In other words, the insulated rocker cover itself contributes to the noise-suppression of the cylinderhead and valve actuating elements.

In further development of the invention the circumferential edge or rim of the rocker cover is extended downwardly beyond the vibration-absorbing gasket and further sealed relative to the induction manifold and the two U-shaped parts by a suitable seal so that noise emission from this region, too, is inhibited.

DESCRIPTION OF THE DRAWINGS

The invention is hereinafter more particularly described in various embodiments thereof which are illustrated in simplified form in the accompanying drawings wherein.

DESCRIPTION OF THE PREFERRED EMBODIMENTS

Figure 1:
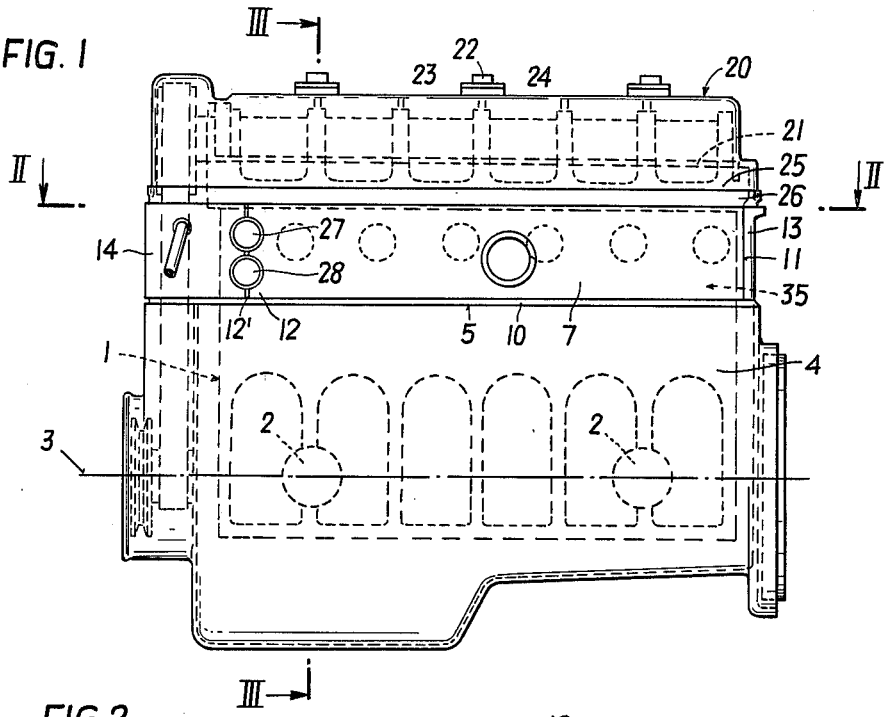
FIG. 1 is a side view of an internal combustion engine constructed in accordance with the present invention.
Figure 2:
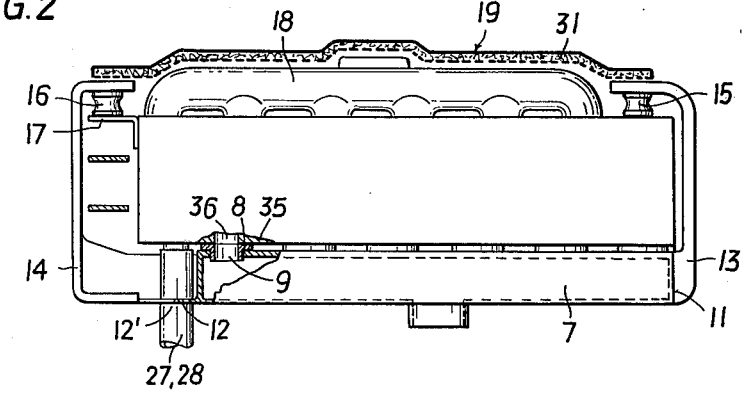
FIG. 2 is a horizontal section taken along line II—II in FIG. 1.
Figure 3:
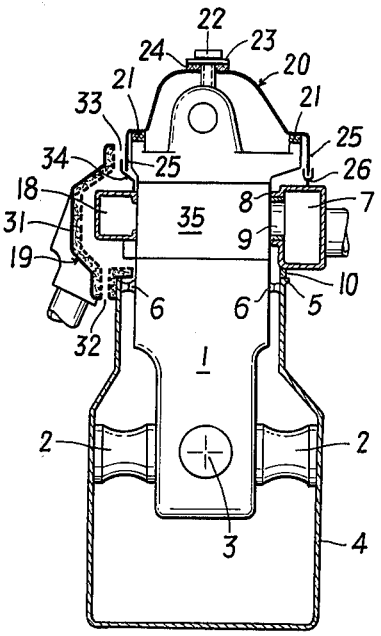
FIG. 3 is a vertical section taken along line III—III in FIG. 1.

The internal combustion engine shown in FIGS. 1, 2 and 3 comprises an engine unit support 1, which, together with various other elements (not in all cases specifically shown), such as the cylinder block, the cylinder head 35, crankshaft 3 and crankshaft bearings, as well as the valves and valve-actuating elements (not shown) which are substantially associated with and secured to the cylinder head, constitutes the power-transmitting part of the engine. This is also the part which is directly affected by body resonance and sound vibration. The engine unit support 1 is connected in a vibrationally elastic fashion by means of vibration-absorbing elements 2 to the crankcase 4 at approximately the level of the middle of the crankshaft 3, the crankcase 4 extending upwardly above this level to terminate at its upper circumferential edge with a rim 5 and including a continuous sealing element or gasket 6 to provide an upper oil-seal for the crankcase 4.

The induction manifold 7 is insulated against vibration transmission relative to a short pipe 9, which is a press-fit in the cylinder head 35, by means of vibration-absorbing and sealing intermediate rings 8. The two ends 11 and 12 of the induction manifold 7 are each connected to a substantially U-shaped part 13, 14 which embraces the cylinder head 35 and by which the induction manifold is secured either directly or by an angle bracket 17 to the cylinder head 35 with the interposition of vibration-absorbing elements 15 and 16. The U-shaped parts 13, 14 as well as the induction manifold 7 are extended downwardly in that region of the engine which projects beyond the crankcase 4 and jointly sealed relative to the upper edge 5 of the crankcase 4 by a circumferential gasket 10. Thus, the induction manifold 7 as well as the U-shaped parts 13 and 14 screen laterally radiated noise emitted by the directly vibrated engine parts located above the crankcase 4.

The exhaust manifold 18 on the side of the cylinder head opposite the induction manifold 7 is screened against noise emission by a sound-suppressing cover 19 which is secured to the cylinder head 35 by means of the U-shaped parts 13, 14 and vibration-absorbing elements 15, 16.

As shown in FIG. 3, the rocker cover 20 is sealed and isolated relative to the cylinder head 35 by a circumferentially continuous vibration-absorbing gasket 21. The rocker cover 20 is secured by means of screws 22 provided with washers 23 bearing on vibration-absorbing washers 24. This prevents the transmission of noise by direct vibration through the screws 22 to the rocker cover 20 which is otherwise insulated by the gasket 21. Due to these provisions the rocker cover 20 itself becomes a noise-screen component for the valves and valve-actuating elements (not shown) under the cover, and for the upper part of the cylinder head 35. Furthermore, the edge 25 of the rocker cover 20 extends downwardly beyond the gasket 21. The induction manifold 7 and the two U-shaped parts 13, 14 present along their upper edges a circumferentially continuous sealing surface on which the peripheral edge 25 of the rocker cover 20 seats with an interposed seal 26. On the side of the exhaust manifold 18 the downwardly extended rocker cover edge 25 is overlapped by the sound-suppressing cover 19 which is provided on its inwardly directed side with a heat-resistant, noise-deadening cladding 31 and secured to the cylinder head 35 by means of the vibration-absorbing elements 15, 16 on the U-shaped parts 13, 14. The air which rises through the gaps 32 and 33 in the cover 19 cools the interior of the cover 19 and thus prevents overheating.

The gaps 32, 33 also constitue noise-absorbing areas which largely inhibit noise emission in these regions. In order to prevent the heated cooling air from penetrating further up underneath the downwardly extended edge 25 of the rocker cover 20, which would entail undue heat transmission to the gasket 21, a baffle plate 34 is provided in this region. FIGS. 1 and 2 also show the access points for the coolant-feed and return hoses 27, 28. Owing to enlargements provided in the dividing gap 12' between the manifold end 12 and its associated U-part 14, which enlargements are constrictions relative to the hose cross section, it is possible to clamp conventional elastic coolant hoses very simply in place and thus obtain virtually sound-proof access openings for the hoses 27, 28 to the cylinder head.

Figure 5:
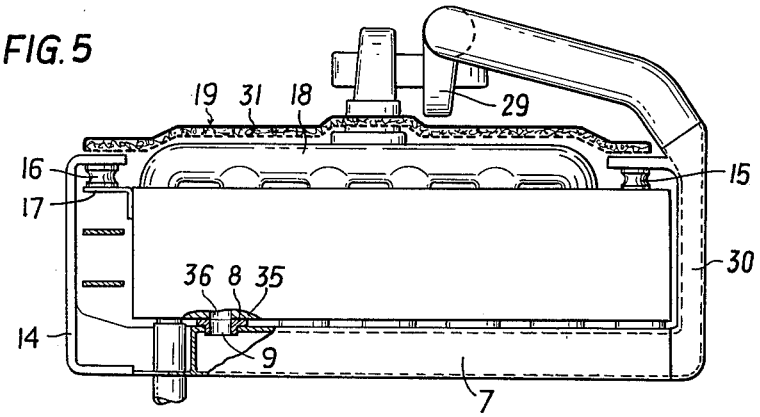
FIG. 5 is a horizontal section taken along line V—V in FIG. 4.
Figure 4:
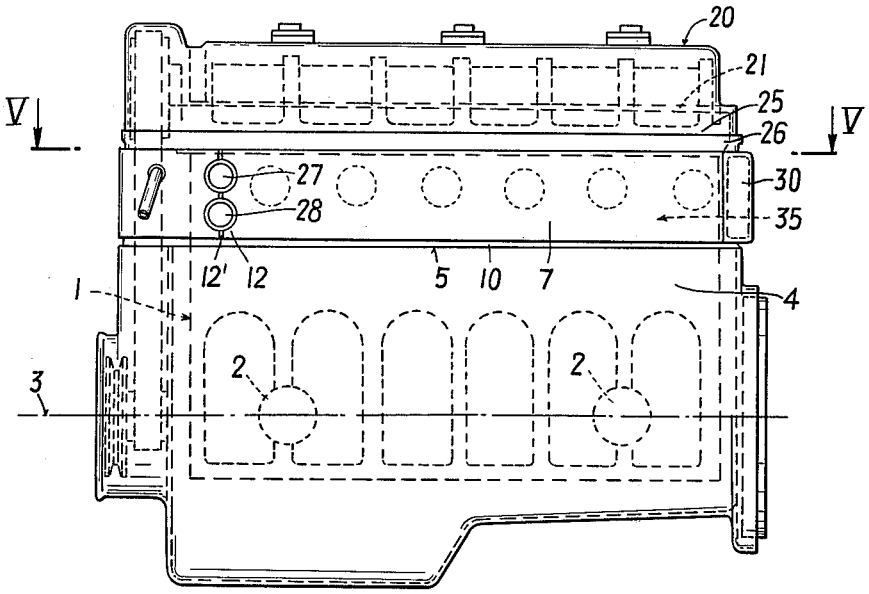
FIG. 4 is a side view of an internal combustion engine constructed according to another embodiment of the present invention.

In a low-noise-level internal combustion engine according to the embodiment of the invention shown in FIGS. 4 and 5 an exhaust-gas-driven turbo-charger 29 is attached to the crankcase 4 on the same side as the exhaust manifold 18. In this embodiment one of the two U-shaped parts associated with the induction manifold 7 is designed as an elbow connector 30 which makes it possible to dispense with yet another noise-deadening part formerly needed for the internal combustion engine. The remaining parts shown in FIGS. 4 and 5 are identical with those described with reference to FIGS. 1 to 3. The vibration-absorbing elements 15, 16 here have the additional function of resisting the thrust generated by the charging pressure which would otherwise push the induction manifold 7 away from the cylinder head.

We claim:

1. In a low noise-level internal combustion engine which includes an engine unit support, a crankshaft mounted for rotation in said engine unit support, a cylinder head, an induction manifold for delivering air or an air/fuel mixture to said cylinder head, a rocker cover and a crankcase constructed to surround a portion of said engine unit support and extend upwardly to a level above said crankshaft, the improvement wherein at least one vibration-absorbing connector element is connected between said engine unit support and said crankcase, wherein a number of vibration-absorbing and sealing intermediate rings are positioned between said induction manifold and said cylinder head, and wherein said rocker cover is directly attached to said cylinder head by at least one vibration-absorbing attachment element, said rocker cover and said induction manifold being constructed so as to at least partially enclose said cylinder head and the portion of said engine unit support which extends upwardly above said crankcase, said rocker cover and said induction manifold acting to suppress the radiation of body resonance and sound vibration emanating from and around said cylinder head and said engine unit support.

2. The low noise-level internal combustion engine according to claim 1 wherein a number of short pipes project outwardly from said cylinder head and extend through openings in said induction manifold to terminate therein, wherein each vibration absorbing and sealing intermediate ring has a generally T-shaped hollow cross section, and wherein a separate vibration absorbing and sealing intermediate ring is positioned around each short pipe such that the adjacent portion of the induction manifold is vibrationally protected from both said short pipe and said cylinder head.

3. The low noise-level internal combustion engine according to claim 1 wherein each vibration-absorbing attachment element includes a screw having a head portion and a shank portion, said screw extending from its head portion through a hole in said rocker cover and with its shank portion into said cylinder head, and a vibration-absorbing washer position around its shank portion between its head portion and said rocker cover.

4. The low noise-level internal combustion engine according to claim 3 including a continuous vibration-absorbing gasket positioned between said rocker cover and said cylinder head therebelow.

5. The low noise-level internal combustion engine according to claim 1 wherein said induction manifold is elongated and is located along a first side of said cylinder head, wherein said induction manifold has opposite ends, and wherein each of the opposite ends of said induction manifold is connected to a first leg of a U-shaped part, the second leg of each U-shaped part being attached to the second side of said cylinder head.

6. The low noise-level internal combustion engine according to claim 5 wherein a separate vibration absorbing mounting element is located between said second leg of each U-shaped part and the second side of said cylinder head.

7. The low noise-level internal combustion engine according to claim 6 wherein an exhaust manifold is connected to the second side of said cylinder head.

8. The low noise-level internal combustion engine according to claim 7 wherein a sound-suppressing lateral cover is connected between said second legs of said U-shaped parts, said sound-suppressing lateral cover being spaced away from both the second side of said cylinder head and said exhaust manifold.

9. The low noise-level internal combustion engine according to claim 8 wherein cooling hoses are connected to said cylinder head along the first side thereof and extend through respective access passages provided between said induction manifold and the first leg of one of said U-shaped parts, each said access passage being smaller in diameter than the diameter of the cooling hose passing therethrough.

10. The low noise-level internal combustion engine according to claim 1 wherein the upper end of said crankcase terminates in a rim and wherein an elastic lip seal is positioned between said rim and the adjacent downwardly facing sides of said induction manifold and said U-shaped parts.

11. The low noise-level internal combustion engine according to claim 1 wherein the upwardly facing sides of said induction manifold and said U-shaped parts mount an elongated vibration-absorbing seat means, and wherein said rocker cover is shaped to include a lower edge, at least a portion of said lower edge being seated in said vibration-absorbing seat means.

12. The low noise-level internal combustion engine according to claim 11 wherein a baffle plate is attached to said cylinder head along the second side thereof and wherein the portion of said lower edge of said rocker cover not seated in said vibration-absorbing seat means extends between said baffle plate and the second side of said cylinder head.

13. The low noise-level internal combustion engine according to claim 1 wherein each said vibration-absorbing connector element is connected between said engine unit support and said crankcase at about the level of said crankshaft.

14. The low noise-level internal combustion engine according to claim 1 wherein said cylinder head is located on top of said engine unit support.

* * * * *